US010667052B2

(12) United States Patent
Tang

(10) Patent No.: US 10,667,052 B2
(45) Date of Patent: May 26, 2020

(54) SPEAKER MODULE, AND AUDIO COMPENSATION METHOD AND APPARATUS

(71) Applicant: Huawei Technologies Co., Ltd., Shenzhen (CN)

(72) Inventor: Dong Tang, Xi'an (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/771,035

(22) PCT Filed: Oct. 26, 2015

(86) PCT No.: PCT/CN2015/092873

§ 371 (c)(1),
(2) Date: Apr. 25, 2018

(87) PCT Pub. No.: WO2017/070828

PCT Pub. Date: May 4, 2017

(65) Prior Publication Data

US 2019/0058945 A1 Feb. 21, 2019

(51) Int. Cl.
*H04R 3/04* (2006.01)
*H04R 29/00* (2006.01)

(52) U.S. Cl.
CPC ..... *H04R 3/04* (2013.01); *H04R 29/001* (2013.01); *H04R 2420/05* (2013.01)

(58) Field of Classification Search
CPC ..... H04R 3/04; H04R 29/001; H04R 2420/05
(Continued)

(56) References Cited

U.S. PATENT DOCUMENTS 7,516,065 B2 * 4/2009 Marumoto ..... G10L 21/02 381/71.4
2002/0123254 A1 9/2002 Kato et al.
(Continued)

FOREIGN PATENT DOCUMENTS

CN 1374719 A 10/2002
CN 1781337 A 5/2006
(Continued)

OTHER PUBLICATIONS

RasPi, 2014, GPIO basics 6.*
(Continued)

*Primary Examiner* — William A Jerez Lora
(74) *Attorney, Agent, or Firm* — Conley Rose, P.C.

(57) ABSTRACT

A speaker module, and an audio compensation method and apparatus and relates to the field of terminal technologies. The speaker module includes an audio component and a speaker board. A power contact, a ground contact, and a general-purpose input/output (GPIO) contact are disposed on the speaker board, and a connecting component is disposed between the audio component and the speaker board. A connection status of the GPIO contact is any one of the following. The connecting component is a conductor, and the GPIO contact is conducted to the power contact using the connecting component, the connecting component is a conductor, and the GPIO contact is conducted to the ground contact using the connecting component, or the connecting component is a non-conductor, and the GPIO contact is disconnected from both the power contact and the ground contact.

6 Claims, 2 Drawing Sheets

(58) Field of Classification Search
USPC ..... 381/98, 94.5, 124
See application file for complete search history.

(56) References Cited

U.S. PATENT DOCUMENTS

| | | | | |
|---|---|---|---|---|
| 2004/0252858 | A1 | 12/2004 | Boor et al. | |
| 2009/0147134 | A1* | 6/2009 | Iwamatsu | H04N 5/60 348/484 |
| 2010/0290633 | A1* | 11/2010 | Chen | H03G 3/32 381/57 |
| 2013/0044888 | A1* | 2/2013 | Nystrom | H04R 29/001 381/59 |

FOREIGN PATENT DOCUMENTS

| | | | |
|---|---|---|---|
| CN | 202134756 | U | 2/2012 |
| CN | 203574770 | U | 4/2014 |
| CN | 104936099 | * | 1/2015 |
| CN | 104936099 | A | 9/2015 |
| CN | 106207687 | A | 12/2016 |
| EP | 1158833 | A2 | 11/2001 |

OTHER PUBLICATIONS

Machine Translation and Abstract of Chinese Publication No. CN202134756, Feb. 1, 2012, 4 pages.
Foreign Communication From a Counterpart Application, PCT Application No. PCT/CN2015/092873, English Translation of International Search Report dated Aug. 5, 2016, 2 pages.
Foreign Communication From a Counterpart Application, PCT Application No. PCT/CN2015/092873, English Translation of Written Opinion dated Aug. 5, 2016, 6 pages.
Machine Translation and Abstract of Chinese Publication No. CN104936099, Sep. 23, 2015, 18 pages.
Machine Translation and Abstract of Chinese Publication No. CN106207687, Dec. 7, 2016, 19 pages.
Machine Translation and Abstract of Chinese Publication No. CN203574770, Apr. 30, 2014, 12 pages.
Foreign Communication From a Counterpart Application, Chinese Application No. 201580083439.8, Chinese Office Action dated Apr. 30, 2019, 7 pages.

* cited by examiner

SPEAKER MODULE, AND AUDIO COMPENSATION METHOD AND APPARATUS

CROSS-REFERENCE TO RELATED APPLICATION

This application is a U.S. National Stage of International Patent Application No. PCT/CN2015/092873 filed on Oct. 26, 2015, which is hereby incorporated by reference in its entirety.

TECHNICAL FIELD

The present disclosure relates to the field of terminal technologies, and in particular, to a speaker module, and an audio compensation method and apparatus.

BACKGROUND

With rapid development of terminal technologies, an increasing quantity of mobile terminals emerges. A most basic function of these mobile terminals is a communication function. A speaker module is indispensable in a communication process of a mobile terminal. The speaker module includes an audio component and a speaker board. A same type of mobile terminal may be configured with speaker modules manufactured by different manufacturers during a production process, and technical specifications for manufacturing the speaker modules by different manufacturers are different. Therefore, audio parameters of audio components differ to some extent. When the same type of mobile terminal is configured with the speaker modules manufactured by the different manufacturers, audio parameters of such type of mobile terminal are different. Therefore, to ensure consistent audio performance of such type of mobile terminal, manufacturers with similar technical specifications for manufacturing audio components may be selected. However, this limits a selection scope of such type of mobile terminal and does not completely eliminate a difference in audio performance. If audio parameters of an audio component manufactured by a manufacturer with lower technical specifications prevail, the audio performance of such type of mobile terminal is reduced. Therefore, a speaker module, and an audio compensation method and apparatus are urgently required.

SUMMARY

Embodiments of the present disclosure provide a speaker module, and an audio compensation method and apparatus in order to compensate for audio parameters of a same type of apparatus configured with different speaker modules to ensure consistent audio performance of such type of apparatus.

To achieve the foregoing objective, the following technical solutions are used in the embodiments of the present disclosure.

According to a first aspect, a speaker module is provided. The speaker module includes an audio component and a speaker board. A power contact, a ground contact, and a general-purpose input/output (GPIO) contact are disposed on the speaker board, and a connecting component is disposed between the audio component and the speaker board. A connection status of the GPIO contact is any one of the following connection statuses: the connecting component is a conductor, and the GPIO contact is conducted to the power contact using the connecting component, where in this case, the connection status of the GPIO contact may be referred to as a pull-up state, the connecting component is a conductor, and the GPIO contact is conducted to the ground contact using the connecting component, where in this case, the connection status of the GPIO contact may be referred to as a pull-down state, or the connecting component is a non-conductor, and the GPIO contact is disconnected from both the power contact and the ground contact, where in this case, the connection status of the GPIO contact may be referred to as a suspended state.

When the GPIO contact is in each of the foregoing three different connection statuses, each connection status may correspond to a speaker module. Therefore, an embodiment of the present disclosure may provide a maximum of three different speaker modules, and the three speaker modules may be differentiated based on the connection status of the GPIO contact.

With reference to the first aspect, in a first possible implementation of the first aspect, when the connecting component is a conductor, and the GPIO contact is conducted to the power contact using the connecting component, a resistor is disposed between the power contact and a power supply connected to the power contact.

Further, a resistance between the power contact and the power supply connected to the power contact is 10 kilo ohms (KO).

With reference to the first aspect, in a second possible implementation of the first aspect, the connecting component is foam. When the connecting component is a conductor, the connecting component is conductive foam, or when the connecting component is a non-conductor, the connecting component is non-conductive foam.

With reference to the second possible implementation of the first aspect, in a third possible implementation of the first aspect, the conductive foam is conductive foam without filaments.

With reference to the second possible implementation of the first aspect, in a fourth possible implementation of the first aspect, a thickness of the foam is 0.40-0.70 millimeters (mm). When the foam is disposed between the audio component and the speaker board, a thickness of compressed foam is 0.25-0.45 mm.

According to a second aspect, an audio compensation method is provided. The method is applied to an audio compensation apparatus. The audio compensation apparatus includes the speaker module described in any one of the first aspect to the fourth possible implementation of the first aspect. The method includes obtaining an actual status parameter of the GPIO contact, where the actual status parameter of the GPIO contact is used to indicate a connection status of the GPIO contact, based on the connection status of the GPIO contact that is indicated by the actual status parameter of the GPIO contact, querying a correspondence between the connection status of the GPIO contact and a preset status parameter and obtaining a preset status parameter corresponding to the connection status of the GPIO contact, and compensating for an audio parameter of the apparatus if the actual status parameter of the GPIO contact is equal to the preset status parameter.

Different connection statuses of the GPIO contact correspond to different status parameters, and the actual status parameter may be a voltage, a current, a level, or another parameter of the GPIO contact.

In addition, the correspondence between the connection status of the GPIO contact and the preset status parameter is preset.

With reference to the second aspect, in a first possible implementation of the second aspect, if the actual status parameter of the GPIO contact is not equal to the preset status parameter, the audio parameter of the apparatus is not compensated for.

With reference to the second aspect, in a second possible implementation of the second aspect, the compensating for an audio parameter of the apparatus if the actual status parameter of the GPIO contact is equal to the preset status parameter includes determining an identification identifier of the speaker module based on the connection status of the GPIO contact that is indicated by the actual status parameter of the GPIO contact, where the identification identifier is an identifier of a manufacturer of the speaker module, obtaining, based on the identification identifier of the speaker module, a compensation parameter corresponding to the identification identifier of the speaker module from a preset correspondence between an identification identifier and a compensation parameter, and compensating for the audio parameter of the apparatus based on the compensation parameter corresponding to the identification identifier of the speaker module.

The correspondence between an identification identifier and a compensation parameter is preset.

According to a third aspect, an audio compensation apparatus is provided. The apparatus includes the speaker module described in any one of the first aspect to the fourth possible implementation of the first aspect, a processor, and a memory. The memory stores code and data, and the processor may run the code in the memory. The processor is configured to obtain an actual status parameter of the GPIO contact, where the actual status parameter of the GPIO contact is used to indicate a connection status of the GPIO contact, query a correspondence between the connection status of the GPIO contact and a preset status parameter and obtain a preset status parameter corresponding to the connection status of the GPIO contact based on the connection status of the GPIO contact that is indicated by the actual status parameter of the GPIO contact, and compensate for an audio parameter of the apparatus if the actual status parameter of the GPIO contact is equal to the preset status parameter.

With reference to the third aspect, in a first possible implementation of the third aspect, the processor is further configured to skip compensating for an audio parameter of the apparatus if the actual status parameter of the GPIO contact is not equal to the preset status parameter.

With reference to the third aspect, in a second possible implementation of the third aspect, the processor is further configured to determine an identification identifier of the speaker module based on the connection status of the GPIO contact that is indicated by the actual status parameter of the GPIO contact, where the identification identifier is an identifier of a manufacturer that manufactures the speaker module, obtain, based on the identification identifier of the speaker module, a compensation parameter corresponding to the identification identifier of the speaker module from a preset correspondence between an identification identifier and a compensation parameter, and compensate for the audio parameter of the apparatus based on the compensation parameter corresponding to the identification identifier of the speaker module.

In the foregoing technical solutions, the actual status parameter of the GPIO contact and the preset status parameter corresponding to the connection status of the GPIO contact are obtained. If the actual status parameter of the GPIO contact is equal to the preset status parameter, the audio parameter of the apparatus is compensated for, thereby ensuring consistent audio performance of the same type of apparatus configured with different speaker modules. In addition, the audio compensation method provided in the embodiments of the present disclosure is simple, effective, and highly reliable, and can effectively reduce production costs.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show merely some embodiments of the present disclosure, and persons of ordinary skill in the art may still derive other drawings from these accompanying drawings without creative efforts.

Signs in the accompanying drawings: 1. Audio component; 2. Speaker board; 3. Connecting component; 21. Power contact; 22. Ground contact; and 23. GPIO contact.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by persons of ordinary skill in the art based on the embodiments of the present disclosure without creative efforts shall fall within the protection scope of the present disclosure.

An application scenario of the present disclosure is described before the present disclosure is introduced. With rapid development of terminal technologies, mobile terminals are more commonly used, and an increasing quantity of mobile terminals are required. A most basic function of these mobile terminals is a communication function. A speaker module is indispensable in a communication process of a mobile terminal. The speaker module includes an audio component and a speaker board. Currently, in a manufacturing process, a same type of mobile terminal may be configured with speaker modules manufactured by different manufacturers. However, technical specifications or manufacturing techniques of these manufacturers are different. Therefore, audio parameters of audio components differ to some extent. Therefore, when the same type of mobile terminal is configured with the speaker modules manufactured by the different manufacturers, an audio parameter of the mobile terminal needs to be compensated for based on different audio components, to ensure a consistent audio parameter of such type of mobile terminal. That is, the audio parameter of the mobile terminal is compensated for based on different manufacturers of speaker modules.

Figure 1:
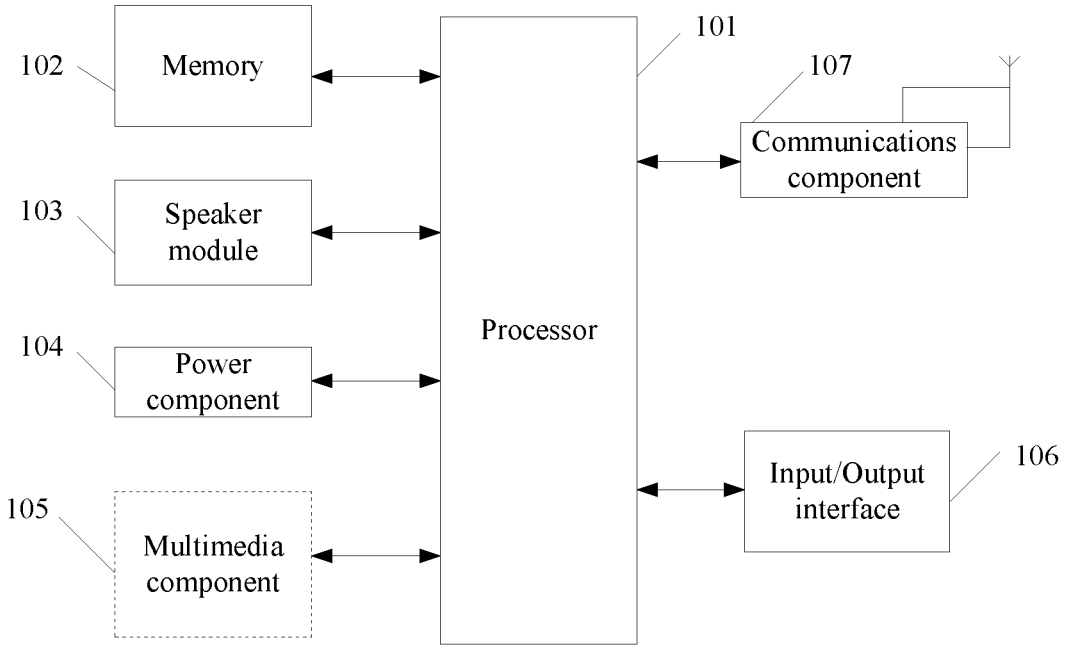
FIG. 1 is a schematic structural diagram of hardware of a terminal according to an embodiment of the present disclosure.

A speaker module and an audio compensation method that are provided in the embodiments of the present disclosure may be applied to an audio compensation apparatus. The audio compensation apparatus may be any apparatus that includes the speaker module, for example, a terminal or another electronic device. The terminal may be a mobile phone, a tablet computer, a notebook computer, an ultra-mobile personal computer (UMPC), a netbook, a personal digital assistant (PDA), or the like. The embodiments of the present disclosure are described using a terminal as an example. FIG. 1 is a block diagram of a part of a structure of a terminal related to the embodiments of the present disclosure.

Persons of ordinary skill in the art may understand that a structure shown in FIG. 1 is merely an example and does not constitute a limitation on the structure of the terminal. For example, the terminal may include more or fewer components than those shown in FIG. 1, or have configurations different from those shown in FIG. 1.

FIG. 1 is a schematic structural diagram of a terminal applied to an embodiment of the present disclosure. As shown in FIG. 1, the terminal includes a processor 101, a memory 102, a speaker module 103, a power component 104, a multimedia component 105, an input/output interface 106, and a communications component 107.

The processor 101 usually controls overall operations of the terminal, such as display, communication, and data transmission operations. The memory 102 may be configured to store various types of data, and the data may be an application program, an instruction, a message, a picture, and the like. The speaker module 103 may include an audio component and a speaker board, and is configured to input/output an audio signal or the like. The power component 104 is configured to supply power to various components of the terminal. The multimedia component 105 may be configured to play a multimedia file or the like. The input/output interface 106 provides an interface between the processor 101 and a peripheral interface module (not shown). For example, the peripheral interface module may be a keyboard or a mouse. The communications component 107 may be configured to enable communication between the terminal and another device.

Figure 2:
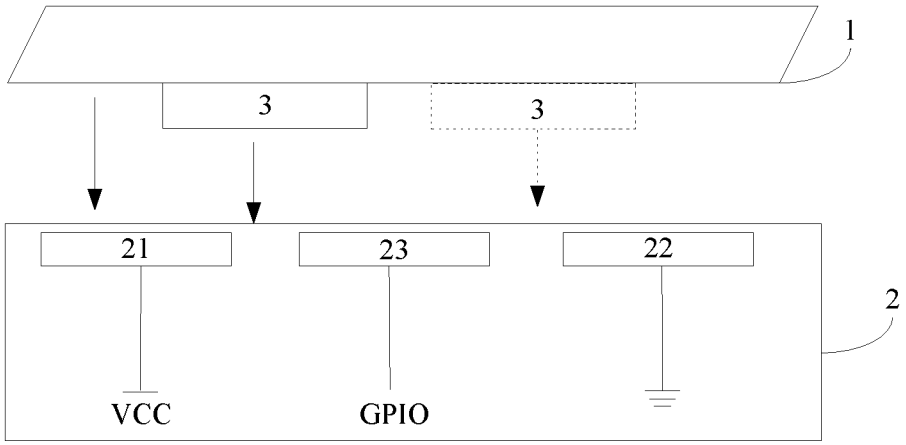
FIG. 2 is a schematic structural diagram of a speaker module according to an embodiment of the present disclosure.

FIG. 2 is a schematic structural diagram of a speaker module according to an embodiment of the present disclosure. The speaker module may be applied to an audio compensation apparatus. As shown in FIG. 2, the speaker module includes an audio component 1 and a speaker board 2. A power contact 21, a ground contact 22, and a GPIO contact 23 are disposed on the speaker board 2, and a connecting component 3 is disposed between the audio component 1 and the speaker board 2. A connection status of the GPIO contact 23 may be any one of the following three connection statuses.

In a first case, the connecting component 3 is a conductor, and the GPIO contact 23 is conducted to the power contact 21 using the connecting component 3. In this case, the connection status of the GPIO contact 23 may be referred to as a pull-up state.

Further, when the connection status of the GPIO contact 23 is the pull-up state, a resistor may be disposed between the power contact 21 and a power supply connected to the power contact 21. Disposing the resistor can reduce leakage current between the power contact 21 and the power supply connected to the power contact 21, thereby protecting the power supply. In addition, this helps identify a status parameter at the GPIO contact 23 subsequently.

Optionally, a resistance of the resistor between the power contact 21 and the power supply connected to the power contact 21 may be 10 KΩ.

In a second case, the connecting component 3 is a conductor, and the GPIO contact 23 is conducted to the ground contact 22 using the connecting component 3. In this case, the connection status of the GPIO contact 23 may be referred to as a pull-down state.

In a third case, the connecting component 3 is a non-conductor, and the GPIO contact 23 is disconnected from both the power contact 21 and the ground contact 22. In this case, the connection status of the GPIO contact 23 may be referred to as a suspended state.

Further, when the GPIO contact 23 is in the suspended state, the GPIO contact 23, the power contact 21, and the ground contact 22 are all disconnected from each other. Therefore, the connecting component 3 may also be omitted. That is, when the connecting component 3 is not disposed between the audio component 1 and the speaker board 2, the connection status of the GPIO contact 23 is also the suspended state.

It should be noted that the speaker board 2 is a circuit board on which the power contact 21, the ground contact 22, and the GPIO contact 23 are disposed. A circuit on the speaker board 2 may be designed directly on a main board of the audio compensation apparatus, or may be designed on an independent circuit board. This embodiment of the present disclosure imposes no limitation thereon.

When the GPIO contact 23 is in each of the foregoing three different connection statuses, each connection status may correspond to a speaker module. Therefore, this embodiment of the present disclosure may provide a maximum of three different speaker modules, and the three speaker modules may be differentiated based on the connection status of the GPIO contact 23.

When the GPIO contact 23 is in different connection statuses, status parameter values corresponding to the GPIO contact 23 are different. Therefore, when the speaker modules are differentiated based on the connection status of the GPIO contact 23, the status parameter at the GPIO contact 23 may be obtained to determine the connection status of the GPIO contact 23, thereby differentiating different speaker modules.

It should be noted that the status parameter may be an electrical parameter corresponding to the GPIO contact 23 when the GPIO contact 23 is in a different connection status. For example, the status parameter may be a level value at the GPIO contact 23.

The connecting component 3 may be a conductor or a non-conductor. When the connecting component 3 is disposed between the audio component 1 and the speaker board 2, the audio component 1 and the speaker board 2 may be in full contact with each other using the connecting component 3. Optionally, the connecting component 3 may be foam. When the connecting component 3 is a conductor, the connecting component 3 is conductive foam, or when the connecting component 3 is a non-conductor, the connecting component 3 is non-conductive foam.

Certainly, it is easily understood that when the connecting component 3 is a non-conductor, the connecting component 3 may be omitted. This is only a simple replacement of this embodiment of the present disclosure.

Further, when the connecting component 3 is conductive foam, to ensure conductivity and safety of the connecting component 3, the conductive foam is conductive foam without filaments.

In addition, when the connecting component 3 is foam, a thickness of the foam in a natural state is 0.40-0.70 mm, and when the foam is disposed between the audio component 1 and the speaker board 2, a thickness of compressed foam is 0.25-0.45 mm.

Optionally, when the connecting component 3 is foam, a thickness of the foam in a natural state is 0.50 mm, and when the foam is disposed between the audio component 1 and the speaker board 2, a thickness of compressed foam is 0.30 mm.

In this embodiment of the present disclosure, the connecting component 3 is disposed between the audio component 1 and the speaker board 2, and the connecting component 3 enables the GPIO contact 23 on the speaker board 2 to be in three different connection statuses. That is, the power contact 21 and the GPIO contact 23 are conducted using the connecting component 3, the ground contact 22 and the GPIO contact 23 are conducted using the connecting component 3, or both the power contact 21 and the ground contact 22 are disconnected from the GPIO contact 23 using the connecting component 3. In this way, different connection statuses correspond to different speaker modules, thereby generating three different speaker modules.

When a same type of audio compensation apparatus is configured with the different speaker modules shown in FIG. 2, to ensure a consistent audio parameter of such type of audio compensation apparatus, audio compensation may be performed based on different speaker modules.

Figure 3:
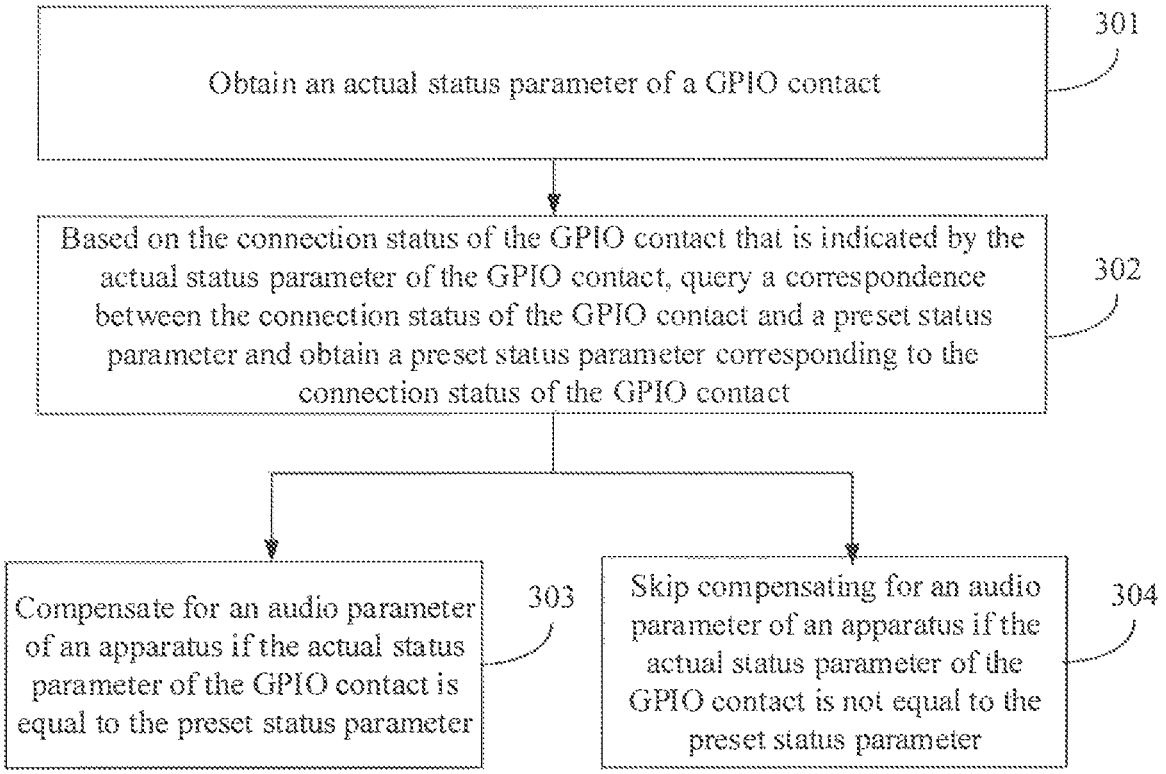
FIG. 3 is a flowchart of an audio compensation method according to an embodiment of the present disclosure.

FIG. 3 is a flowchart of an audio compensation method according to an embodiment of the present disclosure. The method may be applied to an audio compensation apparatus, and the audio compensation apparatus includes the speaker module shown in FIG. 2. As shown in FIG. 2, the audio compensation method includes the following steps.

Step 301: Obtain an actual status parameter of a GPIO contact, where the actual status parameter of the GPIO contact is used to indicate a connection status of the GPIO contact.

Because status parameters corresponding to different connection statuses of the GPIO contact are different, the audio compensation apparatus may obtain the actual status parameter of the GPIO contact. The actual status parameter may be used to indicate a current connection status of the GPIO contact.

It should be noted that the actual status parameter may be a voltage, a current, a level, or the like of the GPIO contact. Certainly, in actual application, the actual status parameter may be another parameter. This embodiment of the present disclosure imposes no limitation thereon.

For example, when the actual status parameter is the level, if the actual status parameter obtained is 1, it indicates that the current connection status of the GPIO contact is a pull-up state, if the actual status parameter obtained is 0, it indicates that the current connection status of the GPIO contact is a pull-down state, or if the actual status parameter obtained is NA, it indicates that the current connection status of the GPIO contact is a suspended state.

Step 302: Based on the connection status of the GPIO contact that is indicated by the actual status parameter of the GPIO contact, query a correspondence between the connection status of the GPIO contact and a preset status parameter and obtain a preset status parameter corresponding to the connection status of the GPIO contact.

It should be noted that the correspondence between the connection status of the GPIO contact and the preset status parameter is preset. For example, a preset status parameter corresponding to the pull-up state of the GPIO contact is 1, a preset status parameter corresponding to the pull-down state of the GPIO contact is 0, and a preset status parameter corresponding to the suspended state of the GPIO contact is not applicable. This embodiment of the present disclosure imposes no limitation thereon.

When the audio compensation apparatus obtains the actual status parameter of the GPIO contact, to determine whether the actual status parameter is consistent with the preset status parameter, the apparatus queries and obtains, based on the connection status of the GPIO contact that is indicated by the actual status parameter of the GPIO contact, the preset status parameter corresponding to the connection status of the GPIO contact from the preset correspondence between the connection status of the GPIO contact and the preset status parameter.

Step 303: Compensate for an audio parameter of the apparatus if the actual status parameter of the GPIO contact is equal to the preset status parameter.

When the actual status parameter of the GPIO contact is equal to the preset status parameter, the apparatus may determine an identification identifier of the speaker module based on the connection status of the GPIO contact that is indicated by the actual status parameter of the GPIO contact. The identification identifier is an identifier of a manufacturer of the speaker module.

Then, the apparatus obtains, based on the identification identifier of the speaker module, a compensation parameter corresponding to the identification identifier of the speaker module from a preset correspondence between an identification identifier and a compensation parameter, and compensates for the audio parameter of the apparatus based on the compensation parameter corresponding to the identification identifier of the speaker module.

It should be noted that the identifier of the manufacturer of the speaker module may be identified by a name, a code, or the like of the manufacturer, or may be identified by a color or a special material of a connecting component in the speaker module. For example, a color of a connecting component in a speaker module of a manufacturer 1 is red, and a color of a connecting component in a speaker module of a manufacturer 2 is green. This embodiment of the present disclosure imposes no limitation thereon.

In addition, because the identification identifier of the speaker module is the identifier of the manufacturer of the speaker module, and the audio parameter corresponding to the speaker module of the manufacturer is fixed, the compensation parameter for compensating for the apparatus based on the audio parameter is also fixed. Therefore, the identification identifier of the speaker module and the corresponding compensation parameter may be prestored in the correspondence between an identification identifier and a compensation parameter.

Step 304: Skip compensating for an audio parameter of the apparatus if the actual status parameter of the GPIO contact is not equal to the preset status parameter.

In this embodiment of the present disclosure, the actual status parameter of the GPIO contact and the preset status parameter corresponding to the connection status of the GPIO contact are obtained. If the actual status parameter of the GPIO contact is equal to the preset status parameter, the audio parameter of the apparatus is compensated for, thereby ensuring consistent audio performance of a same type of apparatus configured with different speaker modules. In addition, the audio compensation method provided in this embodiment of the present disclosure is simple, effective, and highly reliable, and can effectively reduce production costs.

Figure 4:
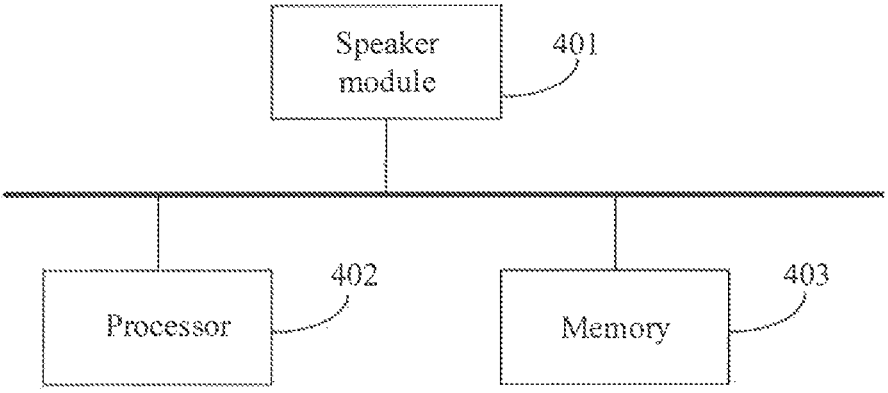
FIG. 4 is a schematic structural diagram of an audio compensation apparatus according to an embodiment of the present disclosure.

FIG. 4 is an audio compensation apparatus according to an embodiment of the present disclosure. The apparatus includes the speaker module 401 shown in FIG. 2, a processor 402, and a memory 403. The memory 403 stores code and data, and the processor 402 may run the code in the memory 403. The processor 402 is configured to obtain an actual status parameter of the GPIO contact, where the actual status parameter of the GPIO contact is used to indicate a connection status of the GPIO contact, based on the connection status of the GPIO contact that is indicated by the actual status parameter of the GPIO contact, query a correspondence between the connection status of the GPIO contact and a preset status parameter and obtain a preset status parameter corresponding to the connection status of the GPIO contact, and compensate for an audio parameter of the apparatus if the actual status parameter of the GPIO contact is equal to the preset status parameter, or optionally, skip compensating for an audio parameter of the apparatus if the actual status parameter of the GPIO contact is not equal to the preset status parameter.

The processor 402 is further configured to determine an identification identifier of the speaker module based on the connection status of the GPIO contact that is indicated by the actual status parameter of the GPIO contact, where the identification identifier is an identifier of a manufacturer that manufactures the speaker module, obtain, based on the identification identifier of the speaker module, a compensation parameter corresponding to the identification identifier of the speaker module from a preset correspondence between an identification identifier and a compensation parameter, and compensate for the audio parameter of the apparatus based on the compensation parameter corresponding to the identification identifier of the speaker module.

This embodiment of the present disclosure provides the audio compensation apparatus. By obtaining the actual status parameter of the GPIO contact and the preset status parameter corresponding to the connection status of the GPIO contact, the processor 402 in the apparatus compensates for the audio parameter of the apparatus if the actual status parameter of the GPIO contact is equal to the preset status parameter, thereby ensuring consistent audio performance of a same type of apparatus configured with different speaker modules and effectively reducing production costs.

Finally, it should be noted that the foregoing embodiments are merely intended for describing the technical solutions of the present disclosure but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of the present disclosure.

What is claimed is:

1. An audio compensation method applied to an audio compensation apparatus comprising a speaker circuit, the method comprising:

obtaining an actual status parameter of a general-purpose input/output (GPIO) contact of the speaker circuit;

obtaining a coupling status of the GPIO contact based on the actual status parameter of the GPIO contact, wherein the coupling status is a pull-up state, a pull-down state, or a suspended state, and wherein the coupling status is different than the actual status parameter;

obtaining a first preset status parameter corresponding to the coupling status of the GPIO contact by querying, using the coupling status of the GPIO contact, a correspondence relating each of the pull-up state, the pull-down state, and the suspended state to respective preset status parameters;

comparing the actual status parameter to the first preset status parameter; and compensating for an audio parameter of the audio compensation apparatus when the actual status parameter of the GPIO contact is equal to the first preset status parameter.

2. The method of claim 1, further comprising skipping compensating for the audio parameter of the audio compensation apparatus when the actual status parameter of the GPIO contact is not equal to the first preset status parameter.

3. The method of claim 1, wherein compensating for the audio parameter of the audio compensation apparatus comprises:

determining an identification identifier of the speaker circuit based on the coupling status of the GPIO contact indicated by the actual status parameter of the GPIO contact, wherein the identification identifier comprises an identifier of a manufacturer of the speaker circuit;

obtaining, based on the identification identifier of the speaker circuit, a compensation parameter corresponding to the identification identifier of the speaker circuit from a preset correspondence between identification identifiers and compensation parameters; and compensating for the audio parameter of the audio compensation apparatus based on the compensation parameter corresponding to the identification identifier of the speaker circuit.

4. An audio compensation apparatus, comprising:

a speaker circuit;

a processor coupled to the speaker circuit; and a memory coupled to the processor and configured to store code that, when executed by the processor, causes the processor to be configured to:

obtain an actual status parameter of a general-purpose input/output (GPIO) contact of the speaker circuit;

obtain a coupling status of the GPIO contact based on the actual status parameter of the GPIO contact, wherein the coupling status is either a pull-up state, a pull-down state, or a suspended state, and wherein the coupling status is different than the actual status parameter;

obtain a first preset status parameter corresponding to the coupling status of the GPIO contact by querying, using the coupling status of the GPIO contact, a correspondence relating each of the pull-up state, the pull-down state, and the suspended state to respective preset status parameters;

compare the actual status parameter to the first preset status parameter; and compensate for an audio parameter of the audio compensation apparatus when the actual status parameter of the GPIO contact is equal to the preset status parameter.

5. The audio compensation apparatus of claim 4, wherein the code further causes the processor to be configured to skip compensating for the audio parameter of the audio compensation apparatus when the actual status parameter of the GPIO contact is not equal to the first preset status parameter.

6. The audio compensation apparatus of claim 4, wherein the code further causes the processor to be configured to:

determine an identification identifier of the speaker circuit based on the coupling status of the GPIO contact indicated by the actual status parameter of the GPIO contact, wherein the identification identifier comprises an identifier of a manufacturer of the speaker circuit;

obtain, based on the identification identifier of the speaker circuit, a compensation parameter corresponding to the identification identifier of the speaker circuit from a preset correspondence between identification identifiers and compensation parameters; and compensate for the audio parameter of the audio compensation apparatus based on the compensation parameter corresponding to the identification identifier of the speaker circuit.

* * * * *